US010393379B2

(12) United States Patent
Lev et al.

(10) Patent No.: US 10,393,379 B2
(45) Date of Patent: Aug. 27, 2019

(54) REMOTELY-CONTROLLED CANDLE

(71) Applicant: Candle Touch Ltd., Rishon Letzion (IL)

(72) Inventors: Moshe Lev, Omer (IL); Roy Shkoury, Rehovot (IL)

(73) Assignee: CANDLE TOUCH LTD., Rishon Letzion (IL)

( * ) Notice: Subject to any disclaimer, the term of this patent is extended or adjusted under 35 U.S.C. 154(b) by 202 days.

(21) Appl. No.: 15/532,105

(22) PCT Filed: Dec. 10, 2015

(86) PCT No.: PCT/IL2015/051198

§ 371 (c)(1),
(2) Date: Jun. 1, 2017

(87) PCT Pub. No.: WO2016/092551

PCT Pub. Date: Jun. 16, 2016

(65) Prior Publication Data

US 2017/0268775 A1 Sep. 21, 2017

(30) Foreign Application Priority Data

Dec. 11, 2014 (IL) ..... 236217

(51) Int. Cl.
*C11C 5/00* (2006.01)
*F23D 3/16* (2006.01)
(Continued)

(52) U.S. Cl.
CPC ..... *F23Q 21/00* (2013.01); *C11C 5/00* (2013.01); *C11C 5/008* (2013.01); *F23D 3/16* (2013.01); *F23D 3/24* (2013.01); *F23Q 25/00* (2013.01)

(58) Field of Classification Search
CPC ..... C11C 5/00; C11C 5/008; F23D 3/16
(Continued)

(56) References Cited

U.S. PATENT DOCUMENTS 3,183,688 A * 5/1965 Sobelson ..... F21V 37/00 431/126
3,905,746 A 9/1975 Patrikios
(Continued)

FOREIGN PATENT DOCUMENTS

| | | |
|---|---|---|
| JP | 2004071526 | 3/2004 |
| WO | 2008074269 | 6/2008 |
| WO | 2008132733 | 11/2008 |

*Primary Examiner* — Gregory L Huson
*Assistant Examiner* — Nikhil P Mashruwala
(74) *Attorney, Agent, or Firm* — Mark M. Friedman

(57) ABSTRACT

A remotely-controlled candle device, which comprises (a) an enclosure containing combustible material; (b) a wick disposed. within the combustible material, by which the combustible material is drawn upwardly by capillary action; (c) an electric unit in which is housed control and communication equipment and a battery for powering the equipment; (d) an ignition device in heat exchanger relation with an upper end of the wick and controlled by the control equipment, for controllably igniting the upper end and producing a flame; (e) one or more conductive elements connected to both the electric unit and to the ignition device; and (f) an extinguishing device controlled by the control equipment for controllably extinguishing the flame. The electric unit is operable to receive remote commands from a user device for activating the ignition device and the extinguishing device upon demand. The extinguishing operation if performed gradually.

15 Claims, 10 Drawing Sheets

(51) Int. Cl.
*F23D 3/24* (2006.01)
*F23Q 21/00* (2006.01)
*F23Q 25/00* (2006.01)

(58) Field of Classification Search
USPC ..... 431/33, 253
See application file for complete search history.

(56) References Cited

U.S. PATENT DOCUMENTS

| | | | | | |
|---|---|---|---|---|---|
| 4,234,303 | A * | 11/1980 | Neugart | F21S 13/00 | 431/291 |
| 4,529,376 | A | 7/1985 | Cafolla | | |
| 5,057,005 | A * | 10/1991 | Kwok | F21S 13/00 | 431/253 |
| 5,425,633 | A * | 6/1995 | Cole | F23D 3/08 | 431/291 |
| 6,733,279 | B2 | 5/2004 | Thigpen | | |
| 7,226,284 | B2 * | 6/2007 | Avelar | F21S 13/00 | 431/150 |
| 7,637,737 | B2 * | 12/2009 | Furner | F21V 35/00 | 362/228 |
| 9,810,426 | B2 * | 11/2017 | Bauswell | F23N 5/265 | |
| 2006/0995400 | | 5/2006 | Avelar | | |
| 2007/0072140 | A1 * | 3/2007 | Almodovar | F23D 3/16 | 431/289 |
| 2007/0264603 | A1 * | 11/2007 | Ruff | C11C 5/002 | 431/289 |
| 2008/0227043 | A1 * | 9/2008 | Kitt | F23D 3/16 | 431/292 |
| 2009/1628040 | | 6/2009 | Masterson | | |
| 2017/0030576 | A1 * | 2/2017 | Brisard | F23D 3/16 | |

* cited by examiner

REMOTELY-CONTROLLED CANDLE

FIELD OF THE INVENTION

The invention is related to the field of home appliances. More particularly, the invention relates to a remotely-controlled candle and to a control system therefor.

BACKGROUND OF THE INVENTION

A candle that can be controlled remotely provides first of all a safety measure. There have been cases where lit candles were forgotten and caused a fire, resulting in an extremely dangerous situation that can cause significant damage to property and even loss of lives.

Apart from the obvious safety benefit for a remotely-controlled candle, such a device can be useful in many occasions, for example when a person cannot be present at a certain location and wishes to create a desired ambiance at that location with the use of lit candles prior to his arrival.

Some remotely-controlled candles are known from the prior art.

JP 2004071526 discloses a remote ignition device for igniting a candle via a telephone signal outputted by a wireless telephone device. The received signal is converted to an electric signal and amplified by a control mechanism, and an ignition device is actuated to ignite the wick of a candle.

WO 2008/074269 discloses a remote-controlled light source that has a storage container and/or supply of combustible material, connected with a burner system which is equipped with an ignition system connected to a power source, and, at the same time, the ignition system is connected with a starting system, connected with a controller which is located outside the light source body.

WO 2008/132733 discloses remote candle lighting apparatus. The apparatus comprises ignition means which are fixedly mounted on a platform and positioning means that move the moveable platform relative to the fixed platform in a way that brings the ignition means close to the wick of each candle in turn.

At times, it would be desired to cause a remotely lit candle to become extinguished, to create a partial or complete darkened effect. None of these prior art devices provide means for remotely extinguishing a lit candle.

Therefore, it is an object of the present invention to provide a remotely-controlled candle, provided with the means to light a candle with an actual flame, and to subsequently cause the lit candle to be remotely extinguished whenever desired.

It is another object of the invention to provide a device that can be easily operated and can provide inputs to the user.

Other objects and advantages of the invention will become apparent as the description proceeds.

SUMMARY OF THE INVENTION

The invention is directed to a remotely-controlled candle device, comprising an enclosure containing combustible material; a wick disposed within said combustible material, by which said combustible material is drawn upwardly by capillary action; an electric unit in which is housed control and communication equipment and a battery for powering said equipment; an ignition device in heat exchanger relation with an upper end of said wick and controlled by said control equipment, for controllably igniting said upper end and producing a flame; one or more conductive elements connected to both said electric unit and to said ignition device; and an extinguishing device controlled by said control equipment for controllably extinguishing said flame, wherein said electric unit is operable to receive remote commands from a user device for activating said ignition device and said extinguishing device upon demand.

The extinguishing device preferably comprises a cover that is configured to cover the enclosure and to thereby prevent ingress of additional oxygen needed to sustain the flame.

In one aspect, the cover comprises an active component for initiating an extinguishing operation and an actuator in data communication with the control equipment for actuating said active component upon demand.

In one aspect, the cover is pivotally displaceable between an opened position and a closed position.

In one aspect, the candle device further comprises a planar and stationary support member, a motor mounted onto said support member, and a screw element kinematically connected to said motor for causing vertical displacement of the cover when in the opened position.

In one aspect, the candle device further comprises a nut member threadedly engaged with the screw element, said nut member being configured with an upper foldable appendage from which laterally extends two opposed horizontally oriented pins about which corresponding ears of the cover are able to be pivoted, and being suitably dimensioned so as to be in pressed abutting relation with an outer surface of the support member while engaged with the screw element, so that rotational displacement of the screw element when driven by the motor causes corresponding vertical displacement of the nut member and of the cover connected thereto.

In one aspect, the cover is biased to the closed position, the candle device further comprising one or more vertically extending and elongated abutments attached to the support member with which the corresponding ears are in sliding contact during vertical displacement of the cover to prevent pivotal displacement to a completely closed position. Contact between one of the ears and the corresponding abutment is gradually releasable following sufficient upward displacement of the cover to enable pivotal displacement of the cover to the closed position.

In one aspect, the candle device further comprises apparatus for maintaining the wick in an upright position even after some of the combustible material has been combusted and consumed.

In one aspect, the upright maintaining apparatus comprises a metallic and air filled float that is urged to be in constant contact with an upper free surface of the combustible material which in a liquid state, a wick receiving aperture having a size which is substantially equal to, but slightly greater than, the thickness of the wick being provided in said float to retain the wick at a disposition which is essentially perpendicular to an upper surface of the float.

In one aspect, the ignition device is secured to the float, the electric unit is disposed at a bottom surface of the combustible material containing enclosure, and the one or more conductive elements connected to both said electric unit and to said ignition device extend through the combustible material and are sealed and flexible to accommodate downward displacement of the float.

In one aspect, the combustible material is wax and the ignition device is a filament connected to the one or more conductive elements, a spacer being provided to separate said filament from said wax.

In one aspect, the electric unit is suitable to be connected to the electrically conductive wires and is provided with an on/off switch and a communication unit that is suitable to receive and/or send information to the user, and is configured to turn the switch on or off according to the information provided by the user. The electrically conductive wires can be made of copper.

The electric unit and electrically conductive wires assembly can be monolithic, and they can also be non-disposable, which in that case the electric unit and electrically conductive wires can be re-used and the candle can be operated again simply by filling the device with new wax or a fresh supply of oil.

The electric unit can be provided with a cellular transceiver, or, alternatively or in addition, with Bluetooth and Wi-Fi communication elements.

The candle device can be configured to interface with a smartphone application that is running on the user device.

In one aspect, the application is operable to recognize a voice pattern which is characteristic of blowing on a microphone of the user device and to generate in response a remote command for activating the extinguishing of the candle device.

In one aspect, the electric unit comprises a position detector and a controller in data communication with said position detector which is configured to determine that the user device is separated more than a predefined distance from the candle device.

In one aspect, the candle device is configured to send an alert notification via the communication equipment to the user device, when found to be separated from the candle device by more than the predefined distance, as to a risk that the flame remains lit.

In one aspect, the candle device is configured to automatically activate the extinguishing device when the user device is found to be separated from the candle device by more than the predefined distance after having been separated therefrom less than another predefined distance.

In one aspect, the electric unit further comprises an orientation sensor in data communication with the controller that is suitable to detect an angle of the candle device, the controller being operable to transmit an activation signal to the extinguishing device when the detected angle deviates from a predefined angle by greater than a predefined value.

In one aspect, the electric unit further comprises a signal strength sensor in data communication with the controller, the controller being operable to transmit an activation signal to the extinguishing device when the sensed signal strength is less than a predefined value or to transmit a suitable notification to the user device.

In one aspect, the candle is one of a plurality of candle devices that is simultaneously controllable by a single user device.

BRIEF DESCRIPTION OF THE DRAWINGS

The invention will be further illustrated with reference to the appended drawings, wherein.

DETAILED DESCRIPTION OF THE INVENTION

The remotely controlled candle device of the present invention is equipped with means for causing a lit candle to be remotely extinguished. Often the candles are adapted to be continuously lit for extended periods of time, such as an entire day, or even an entire week. If people do not frequent the area of the lit candle during certain hours of the day or night, the benefit of a lit candle may not be realized, and a significant amount of candle related combustible material is consequently not effectively utilized. The candle device may comprise a base that functions as a communication component for interfacing with both extinguishing and ignition means.

Figure 1:
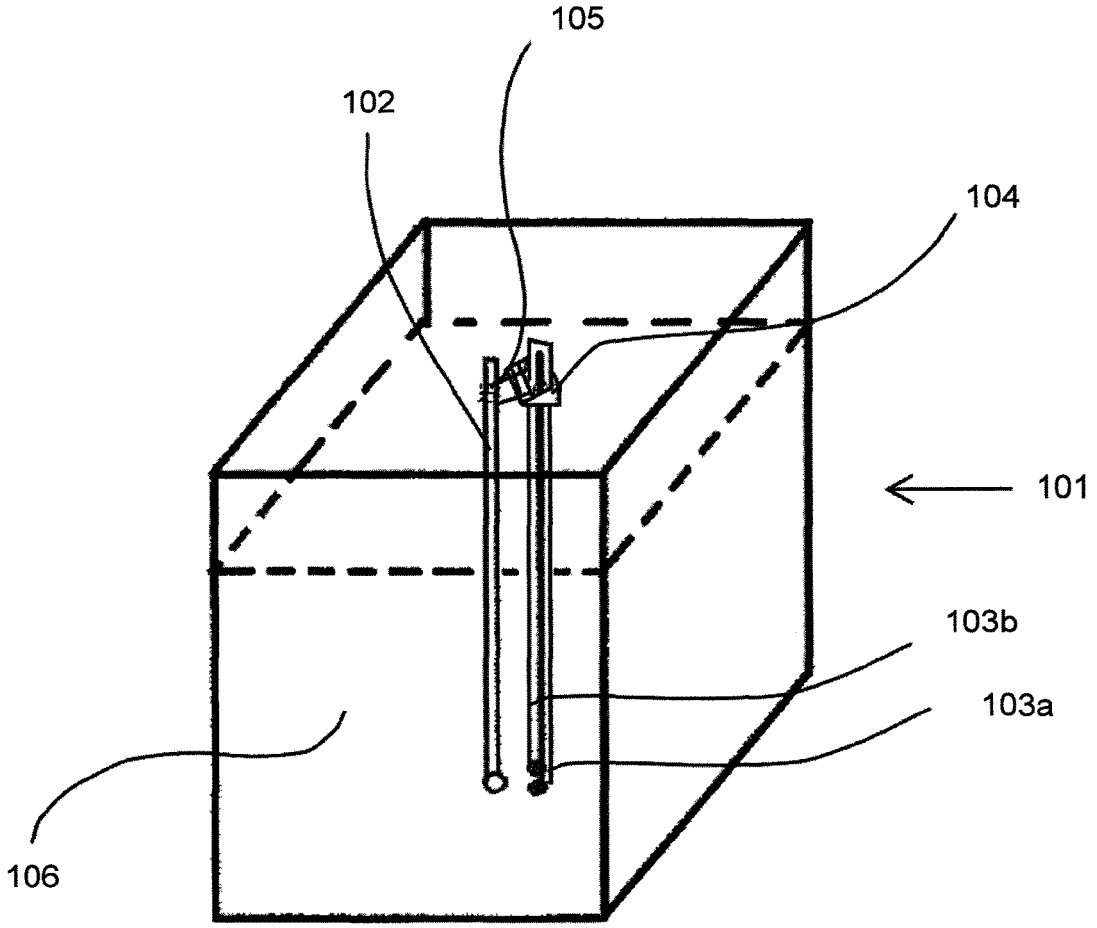
FIG. 1 is a perspective view of a candle device, according to one embodiment of the invention.

FIG. 1 shows candle device 101 that, according to one embodiment of the invention, comprises wick 102, copper wires 103*a* and 103*b*, spacer 104, and filament 105. Copper wires 103*a* and 103*b* are connected to electrical terminals, one to a positive terminal and the other to a negative terminal, and they are also connected to the electronic base of the device (shown in FIG. 2). When the electric circuit is closed, electricity flows through copper wires 103*a* and 103*b* that are in contact with filament 105, causing filament 105 to achieve a higher temperature. Filament 105 is in contact with wick 102, and when filament 105 is sufficiently hot, it ignites the wick. Wick 102 can also be provided with an electrically-conductive material, so that electricity will flow through wick 102 as well, for better ignition.

Copper wires 103*a* and 103 can be replaced with other suitable electrically conductive wires of any material, and for convenience are referred to as "copper wires", but this is not meant to limit the invention to wires that are made only from copper. The use of spacer 104 can be avoided if means are provided to avoid contact between filament 105 and the wax of the candle, such as, for instance, provided that filament 105 itself functions as a spacer, and comprises the geometry and materials suitable to function as spacer 104, as described in the following paragraph.

Candle 101 also comprises wax 106, which can be of any type of known candle wax, such as a solid wax, or a liquid candle wax, such as oil. Wax 106 may be retained in a dedicated enclosure. Spacer 104 may be configured to maintain filament 105 above the wax level so it would not sink within the wax, and its shape is suitable to ensure that it will stay in contact with wax 106 as it is consumed and its level is reduced, allowing filament 105 to continue igniting wick 102 throughout the depth of the wax.

Spacer 104 can be thermally and electrically isolated so that is will not short-circuit the circuit or heat the wax with which it is in contact. Filament 105 may be wrapped around wick 102 and the amount of contact area between them can be determined by the power supply and the temperature that is required for igniting wick 102.

Figure 2:
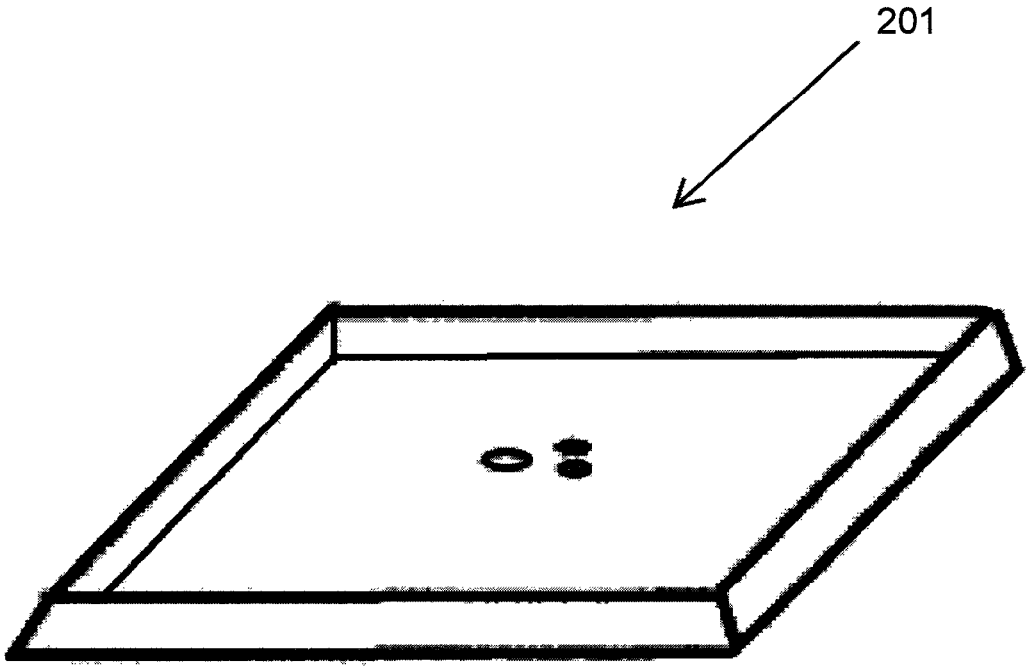
FIG. 2 is a perspective view of the base of the candle device of FIG. 1.

FIG. 2 is a perspective view of base 201 of the device of FIG. 1, which functions as a communication and electric unit. Base 201 comprises a battery or other suitable power source and is adapted to connect electrically to copper wires 103*a* and 103*b*. Wires 103*a* and 103*b* can be permanently connected to base 201 and to spacer 104, and filament 105 can be permanently connected to wires 103*a* and 103, and the re-use of the device will only require a new wick and a fill of wax, but candle 101 can also be disposable and suitable to be connected to base 201.

Figure 3:
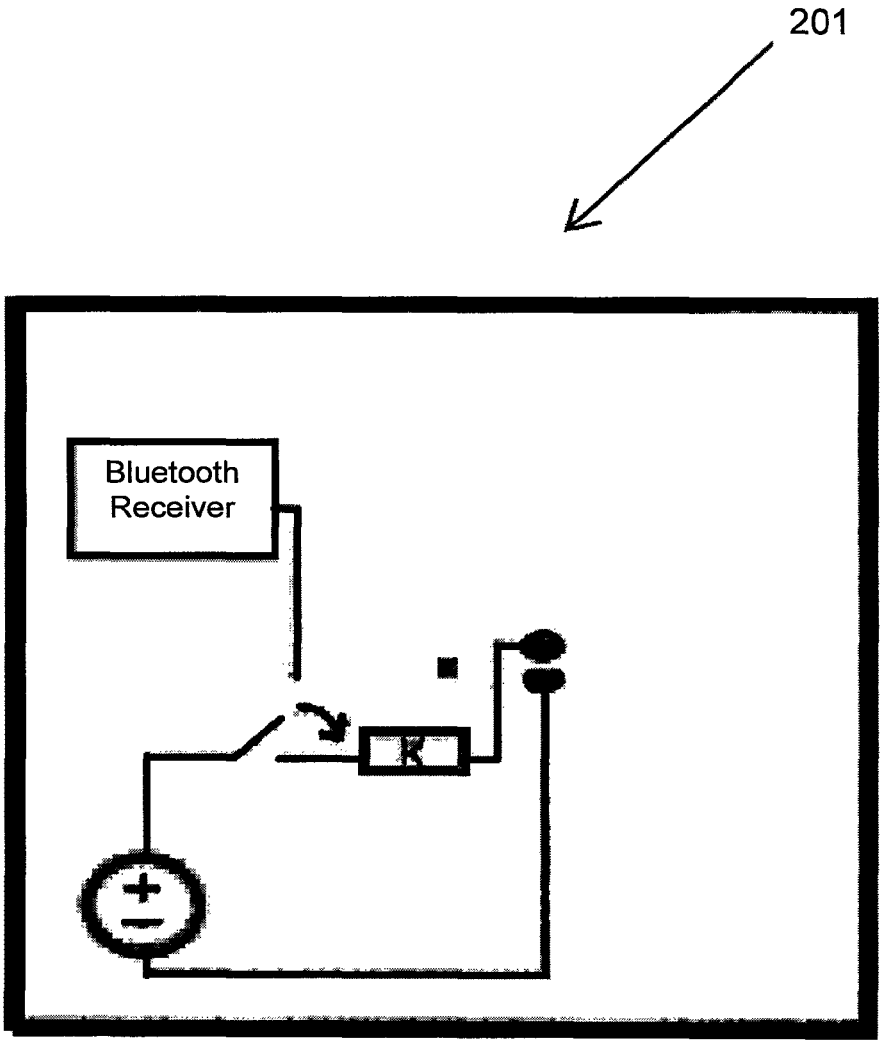
FIG. 3 is a top view of the base of FIG. 2, provided with an exemplary communication unit.

FIG. 3 is a top view of base 201 of FIG. 2, provided with an exemplary communication unit that can be controlled, e.g., by a Bluetooth receiver. Base 201 can be provided with any other kind of communication components that are suitable to receive commands from the user and/or to send information to the user, as will be further described. The control of the user over the device can be performed by any device that has transmission and/or reception abilities, such as a computer or a smartphone.

As mentioned in the above description, candle 101 is lit when the electric circuit of base 201, wires 103*a* and 103*b*, and filament 105 is closed, performed for example by providing a switch (not shown) inside base 201. When the user wants to light candle 101, he sends a command to the communication unit of base 201 that causes the switch to close and electricity to flow through the device, thus lighting candle 101. An off command can be sent by the user, causing the switch to open, thus ending the flow of electricity.

Figure 4:
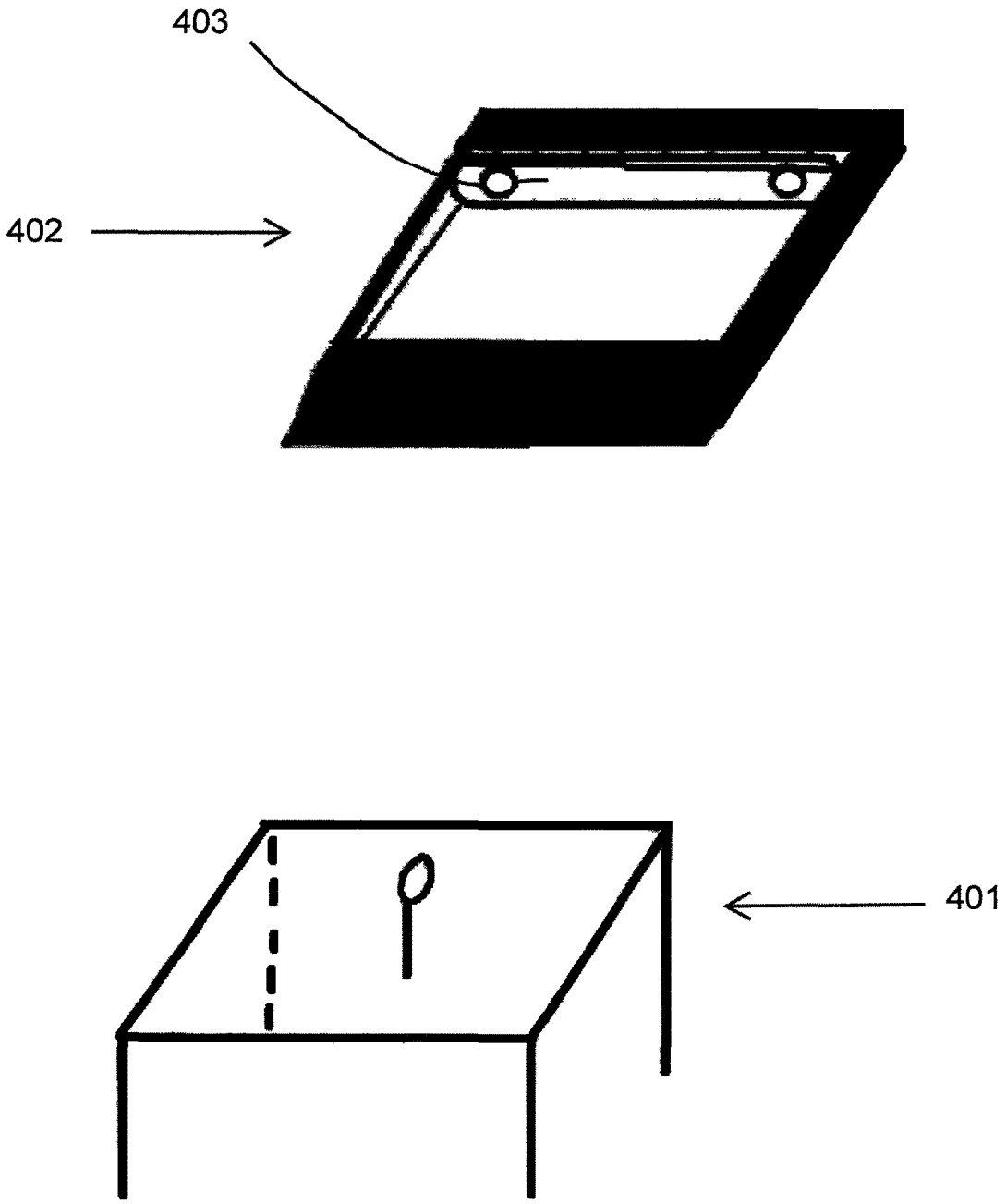
FIG. 4 is a perspective view of the candle device, according to another embodiment of the invention, showing the upper portion of a candle and a cover above it.

When electricity stops flowing through the device, wick 102 can still continue to burn, depending on the material of which wick 102 is made. In order to ensure that the flame will be extinguished, the device can be further provided with a cover, as shown in FIG. 4, which is a perspective and exploded view of the candle device, according to another embodiment of the invention, showing the upper portion of the wax enclosure of candle 401 and cover 402 above it. An efficient way to extinguish a flame is by depriving it of oxygen, which is an essential gas for combustion to take place.

The device can further comprise a sensor that can detect the angle of the wax enclosure, for example to determine whether the wax enclosure is standing on its base or not. Such sensor can be used as a safety component and can have the ability to cause actuation of cover 402 when a lit candle falls, in order to prevent accidents from happening, since any flammable objects in the surroundings of the candle can ignite as a result of the fall.

Cover 402 can be located on top of candle 401 and can be connected to the base of the device or can comprise a receiver of its own, so that the user can send a "close" command to it when he wishes to extinguish the flame. Cover 402 may be provided with shutter 402 that can simply cover the candle, but it can be replaced with any other component, suitable to prevent the supply of oxygen from the ambient to the flame. Alternatively, fire-extinguishing material (such as a liquid or a powder) can also be contained in cover 402 and be released when the appropriate command is received from the user.

The device can be operated via an application for a smartphone or a suitable portable device, a remote controller or a PC, and can communicate with the user through it. The communication can be effected by any known communication means, such as Bluetooth or Wi-Fi. The use of a smartphone has many advantages, since people usually carry their smartphones with them almost at all times, allowing the user to cause candles to be ignited just before arriving, without the need to find an arrangement to create a desired ambiance before his arrival, in cases when this is desired. In addition, the remote control arrangement can be operated on a number of candles, even simultaneously, thereby shortening the time of preparations.

The candle device is suitable for any personal use, and can also be very useful for businesses and public places, for example, restaurants, hotels, and event halls, especially since such places usually require the use of more than a few candles at a time, and the user can very much benefit from the simultaneous control over a number of candles. A remotely-controlled candle device is also useful when a person cannot be present at a memorial service and wishes to light a memorial candle, or cannot be present at a religious candle lighting event.

Almost any smartphone has a GPS application and Bluetooth communication abilities, and the device can be suitable to receive information regarding the location of the user from the smartphone, thereby sending a notification to the user when he is at a certain distance from the device, to indicate that he left without turning off the candle(s). The smart monitoring of the device with respect to the location of the user when the candles are burning can prevent great damage and even save lives. The user can sent an "off" command to the candle device to stop the fire and/or send a command that will operate the cover of the device, thereby extinguishing the flame. The device can also send different kinds of notification, for example, if the battery of the device is close to an end. It is also possible to connect the device to more than one smartphone or a computer or any other appliances that are suitable to communicate with the device.

Figure 5:
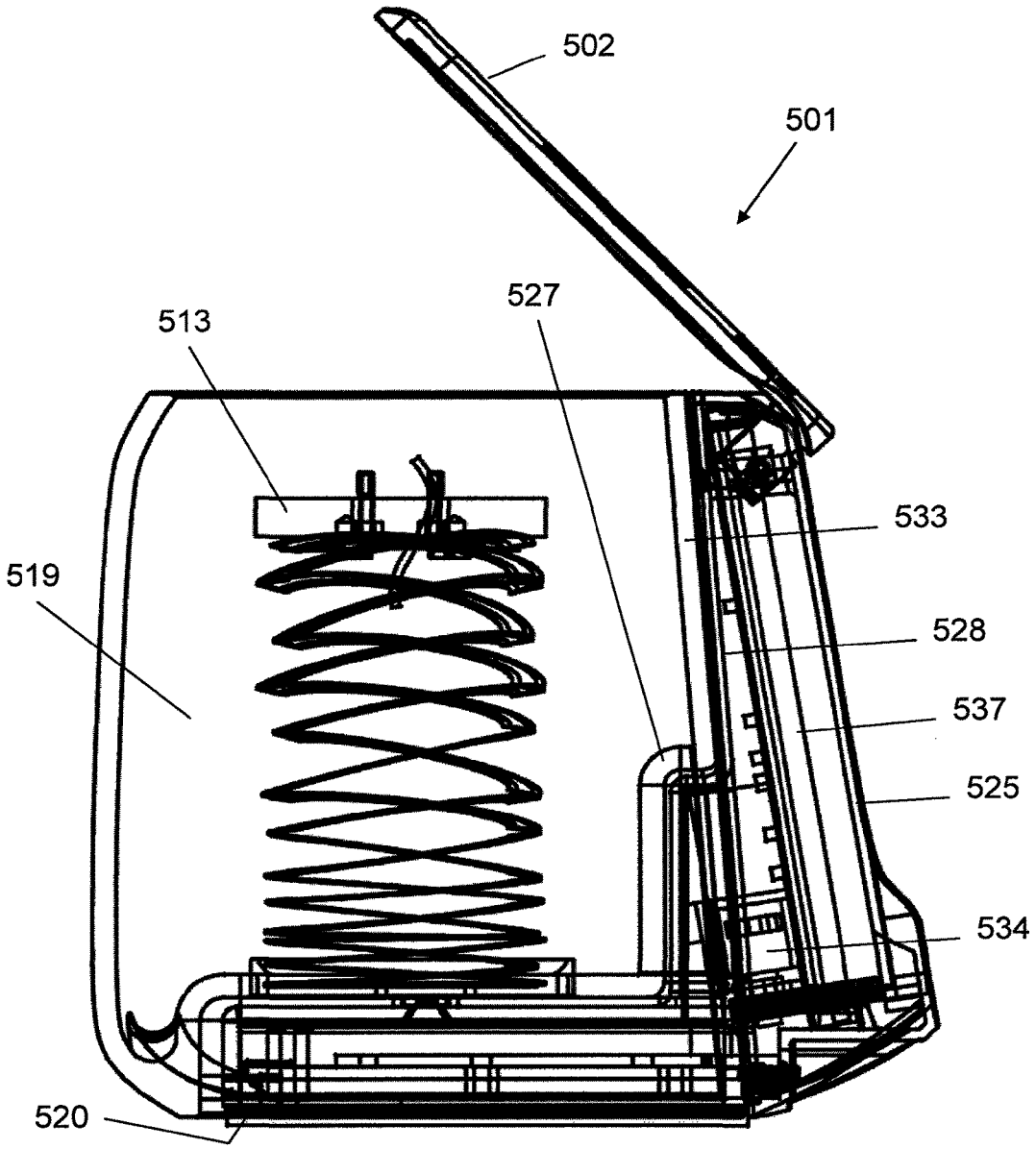
FIG. 5 is a front, partially removed view of a candle device when the cover is set to an opened position, according to another embodiment of the invention.

FIG. 5 illustrates a candle device, generally designated as 501, according to another embodiment of the invention. Candle device 501 comprises a pivotal cover 502 that serves as the extinguishing means, a float 513 disposed within oil or wax enclosure 519 that maintains the wick in a continuous upright disposition, and a sealed base 520 at the bottom of enclosure 519 in which is housed control and communication equipment. An outer casing 525 connected to base 520 and which is only partially illustrated defines enclosure 519 and a drive unit chamber 528. Substantially vertical wall 533 separates enclosure 519 and drive unit chamber 528. A motor 534 for positioning cover 502 is fixed to stationary support member 537, shown to be planar and obliquely disposed, but which can be configured in other ways as well, protrudes from drive unit chamber 528 to enclosure 519, and is protected by shell 527.

Figure 6:
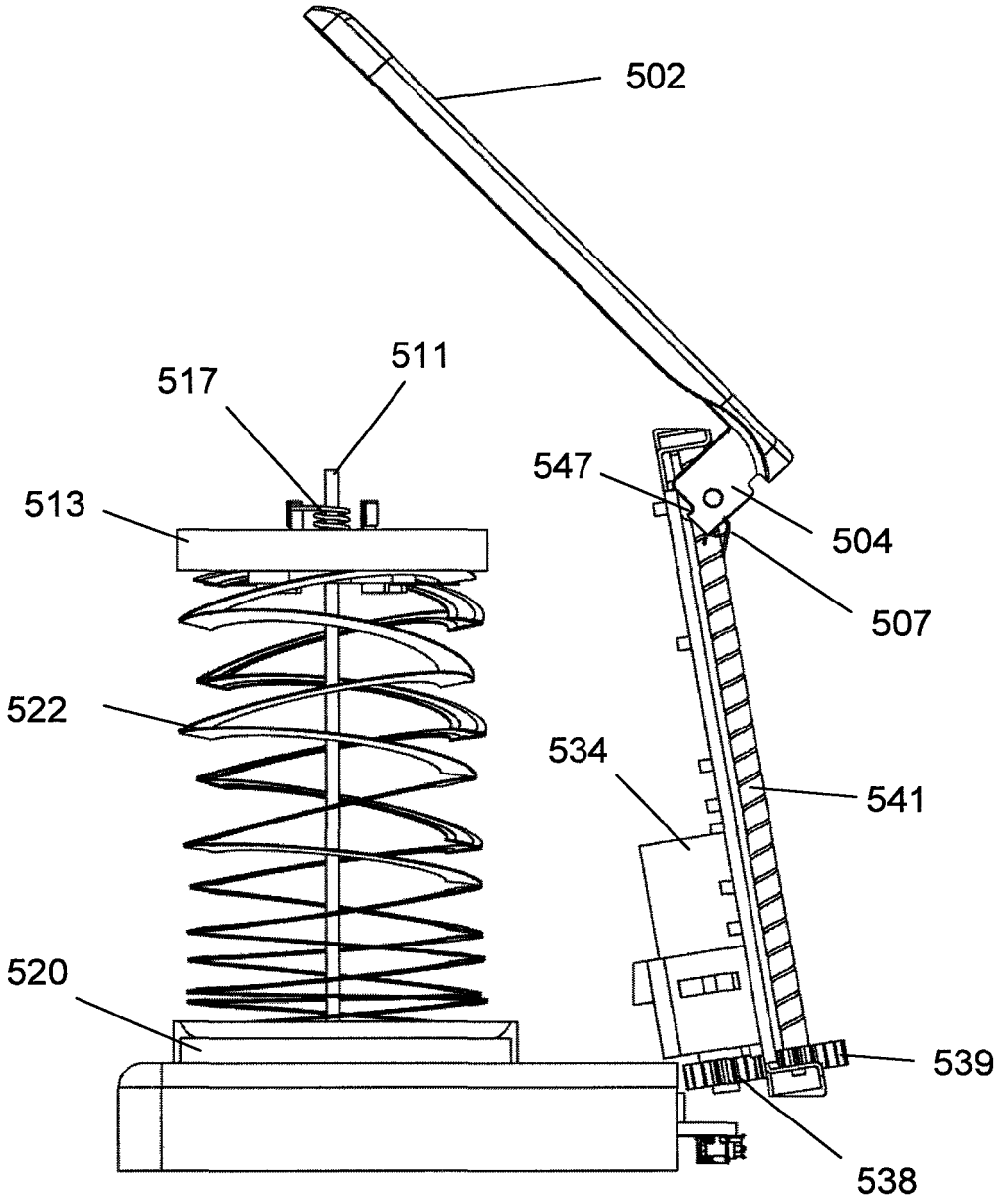
FIG. 6 is a front view of the candle device of FIG. 5 when its casing has been removed and the cover is set to a partially closed position.
Figure 8:
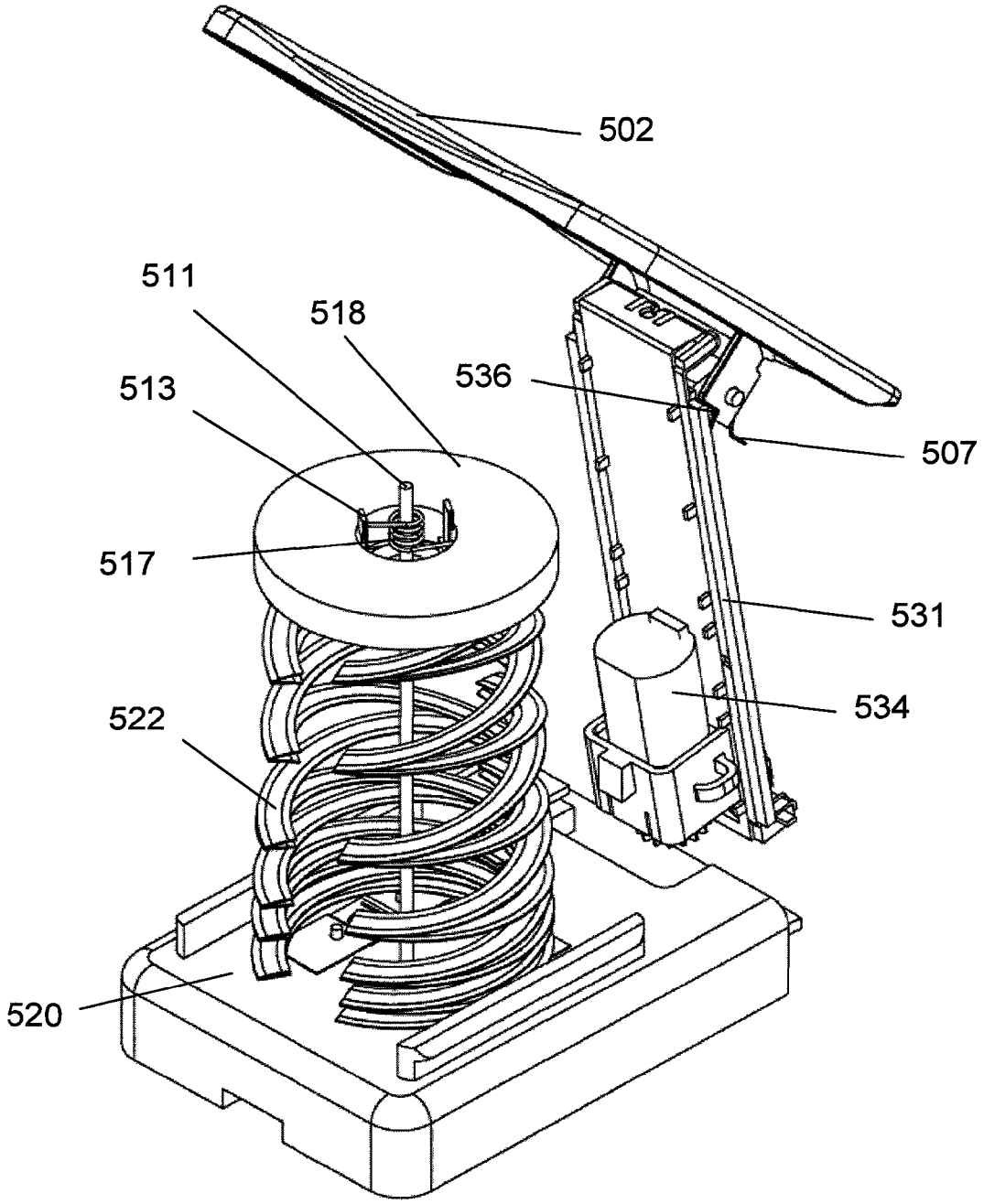
FIG. 8 is a perspective view from above of the candle device of FIG. 5 when its casing has been removed and the cover is set to a partially closed position, showing the ignition device.

As shown in FIGS. 6 and 8, a wick 511 is introduced downwardly through an aperture provided in float 513 until it contacts an upper surface of base 520. The size of the aperture is substantially equal to, but slightly greater than, the thickness of wick 511, to retain the wick at a disposition which is essentially perpendicular to the upper surface of float 513.

In this embodiment, the aperture is defined by a conductive coil 517 connected to two spaced contacts 518 that are secured to an inner wall of float 513 made of heat conductive material, for example by a recess formed in float 513. Float 513 in turn is connected to flexible and sealed conductive elements 522, which may configured as spirals as illustrated or configured in any other desired fashion and extend to, and are electrically connected with, a terminal of base 520. This arrangement allows the flow of current from conductive elements 522 to coil 517 through appropriate isolated openings in the body of float 513 (such that even if float 513 is metallic, it will not carry any current) following generation of a suitable activation signal within base 520 by the control equipment. The current, which is generally greater than 1 amp, flows for a sufficient period of time of greater than approximately 1 sec to heat the resistive coil to a temperature that will cause wick 517 to ignite and form a flame that will consume the combustible material. The value of the current of course is dependent on the thickness and resistance of conductive elements 522 and 517.

Float 513 is hollow and sufficiently air-filled so that it will float on top of combustible material even though it is made of heat conductive material, generally metallic, in order to melt the wax below. The relatively large mass of float 513 urges float 513 to be in constant contact with the upper liquid free surface of the combustible material, such as oil or melted wax, so that the upper surface of float 513 will advantageously be continuously horizontally disposed and wick 511 will be continuously vertically disposed. When some of the combustible material is combusted and consumed, float 513 retains its horizontal disposition and simply floats downwardly.

It will be appreciated that the ability of float 513 to be continuously horizontally disposed promotes the reliable reuse of the candle device after the flame has been extinguished, without concern that the disposition of wick 511 has changed. Prior art floats for use by candle devices, such as those made of cork, have a tendency of changing their disposition and even overturning. With respect to wax candles, the melted wax often causes the disposition of the wick to change, so that the wick will be covered by the melted wax after the flame is extinguished, rendering a relighting operation difficult and at times impossible.

Wick 511 may be ignited by other ways as well, such as by means of a heated wire filament in contact with the wick or an electric spark or an electric arc generated by an electric field applied to an electrode. The current supplied to the ignition means flows through flexible conductive elements 522.

The means for displacing cover 502 will now be described.

Figure 7:
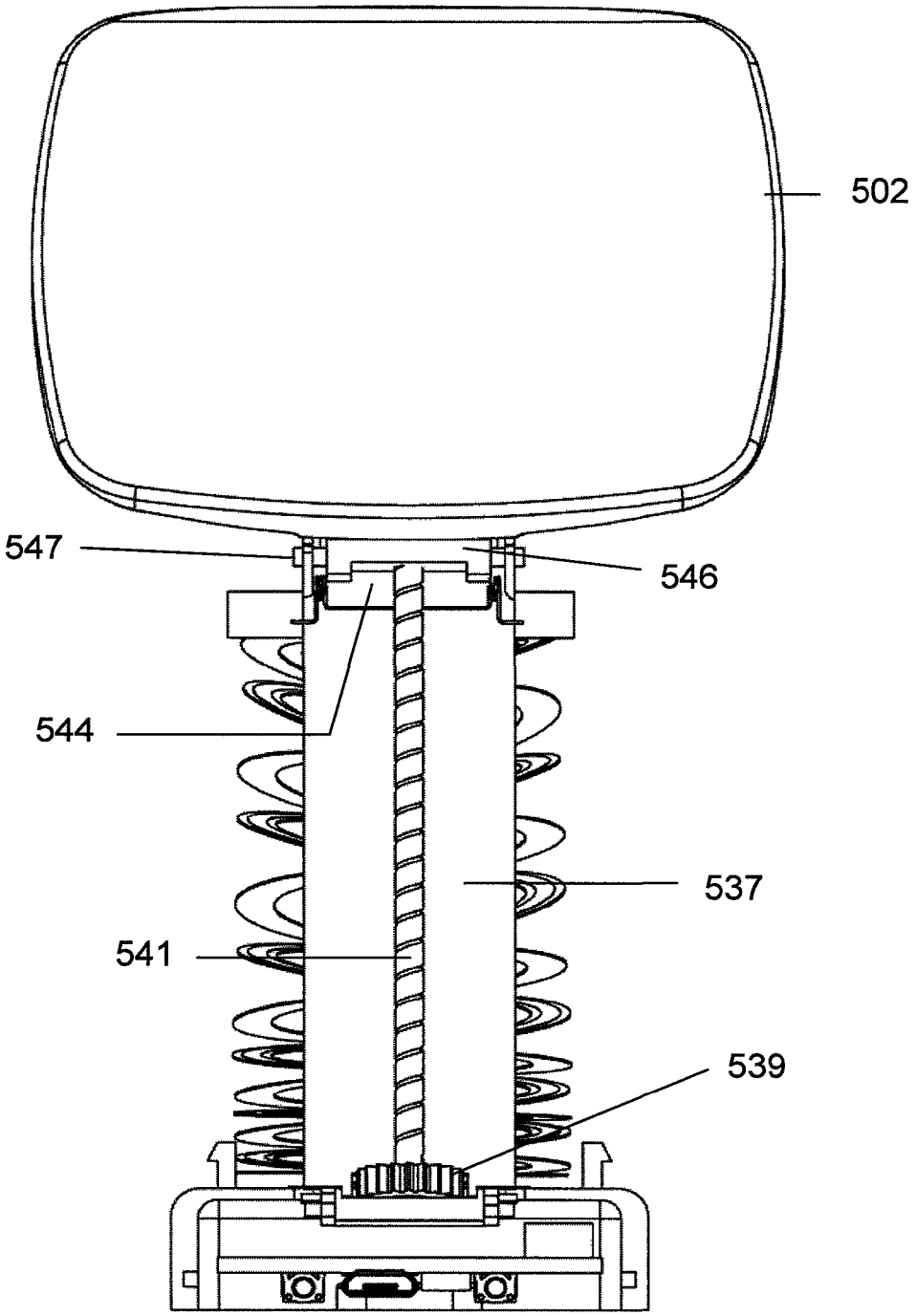
FIG. 7 is a side view of the candle device of FIG. 5 when its casing has been removed and the cover is set to a partially closed position, showing the support member.

As shown in FIGS. 6 and 7, the drive shaft of motor 534, which is downwardly oriented, is kinematically connected to intermeshed gears 538 and 539. A ballscrew 541, or any other elongated element that converts rotary motion into linear motion, is fixedly fitted into gear 539, or integrally formed therewith, and extends upwardly therefrom in a disposition substantially parallel to the outer face of support member 537. The top end of ballscrew 541 is threadedly engaged with nut member 544, which is dimensioned to be in pressed abutting relation with the outer surface of support member 537 while engaged with ballscrew 541. Nut member 544 is also configured with an upper appendage 546 from which laterally extends two horizontally oriented pins 547, one at each end.

Cover 502 has a pair of ears 504, each provided with a hole for receiving a corresponding pin 547, thereby connecting cover 502 with nut member 544. When motor 534 is operated, ballscrew 541 is rotated. Since vertical displacement of ballscrew 541 is prevented by gear 539 to which the ballscrew is fixedly attached, the force causing rotational motion of ballscrew 541 is transmitted to nut member 546, causing the latter to be vertically displaced along the outer surface of support member 537 with which it is in pressing engagement. The vertical displacement of nut member 544 accordingly results in corresponding vertical displacement in the same direction of cover 502 with which it is connected.

Figure 9:
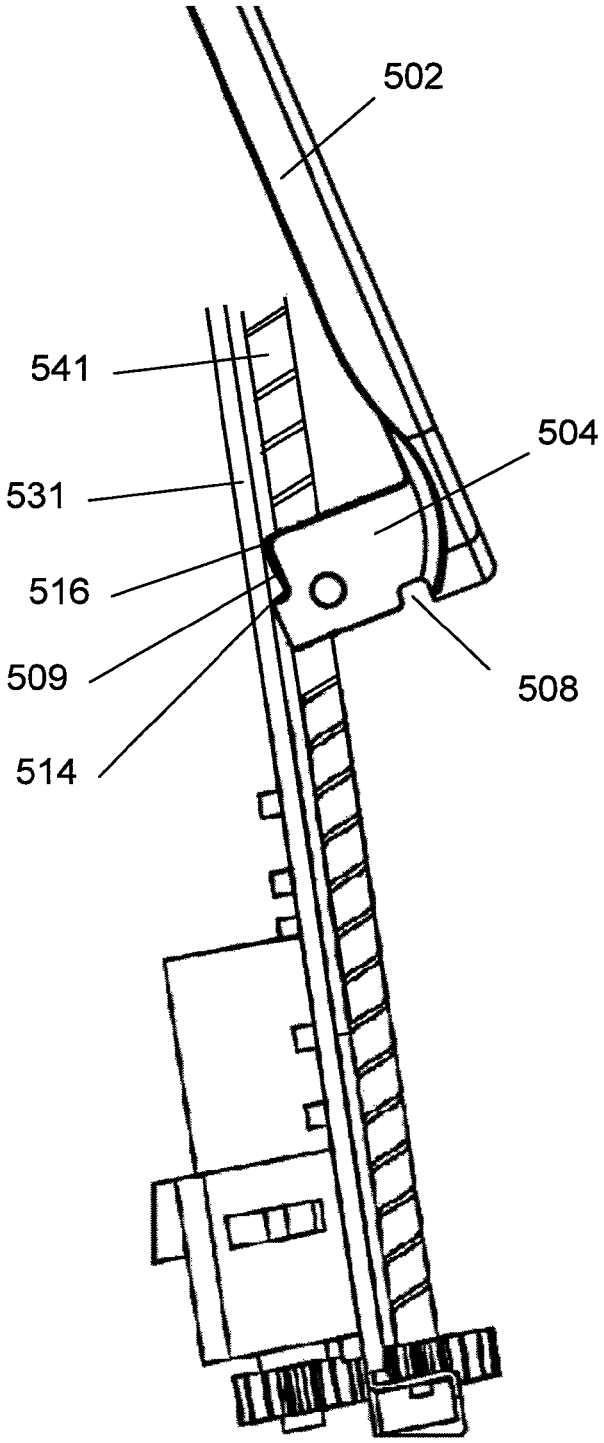
FIG. 9 is an enlarged front view of an abutment used in conjunction with the candle device of FIG. 5, showing sliding contact therewith when the cover is set to a lowered and completely opened position.

The cooperation between ears 504 and the corresponding pins 547 allows cover 502 to be pivoted about the pins. However, as shown in FIGS. 8 and 9, each ear 504 is biased towards a closed position by spring 507, which is engaged with the ear such as within a recess 508, or alternatively within a slit or hole, provided therewith. Due to this biasing action, a portion 514 of ear 504, which is coincident with the bottom edge of the ear when cover 502 is horizontally disposed, contacts a thin and narrow abutment 531 laterally extending from each lateral end of support member 537, to retain cover 502 at an open position, and to prevent it from being additionally closed. Ear 504 may be configured with a small recessed angled section 509 that is formed at an inner corner, i.e. facing towards the enclosure, of the ear, and adjacent to portion 514, to ensure engagement between angled section 509 and an upper corner of abutment 531.

FIG. 9 illustrates cover 502 when it is set at a lowered and completely opened position. Cover 502 is compactly stored in drive unit chamber 528 (FIG. 5) when set at this lowered position. During rotation of ballscrew 541 to effect downward displacement of cover 502 to this lowered position, opposite cornered portions 514 and 516 of ear 504 that are coincident with an edge of angled section 509 slide along abutment 541 by two-point contact and thereby prevent the cover from opening.

When ballscrew 541 rotates in the opposite rotational direction, cover 502 is caused to be upwardly displaced while cornered portions 514 and 516 continue to slide along abutment 541. However, when cover 502 is sufficiently upwardly displaced and upper cornered portion 516 ceases to be in contact with abutment 541 after having passed upper abutment portion 536, cover 502 is forced to rotate in the closed position to a disposition of approximately 45 degrees with respect to a horizontal plane, as illustrated in FIGS. 6 and 8. As upper abutment portion 536 is slightly rounded, additional rotation of ballscrew 541 causes cover 502 to be gradually and additionally closed, until lower cornered portion 514 also ceases to be in contact with upper abutment portion 536 and cover 502 is set to a fully closed position.

Even when cover 502 is set to the fully closed position, an edge of ear 504 continues to contact upper abutment portion 536. Thus cover 502 is assured of being gradually displaced to the opened position when ballscrew 541 rotates in the first direction, and the process described above is reversed.

Figure 10:
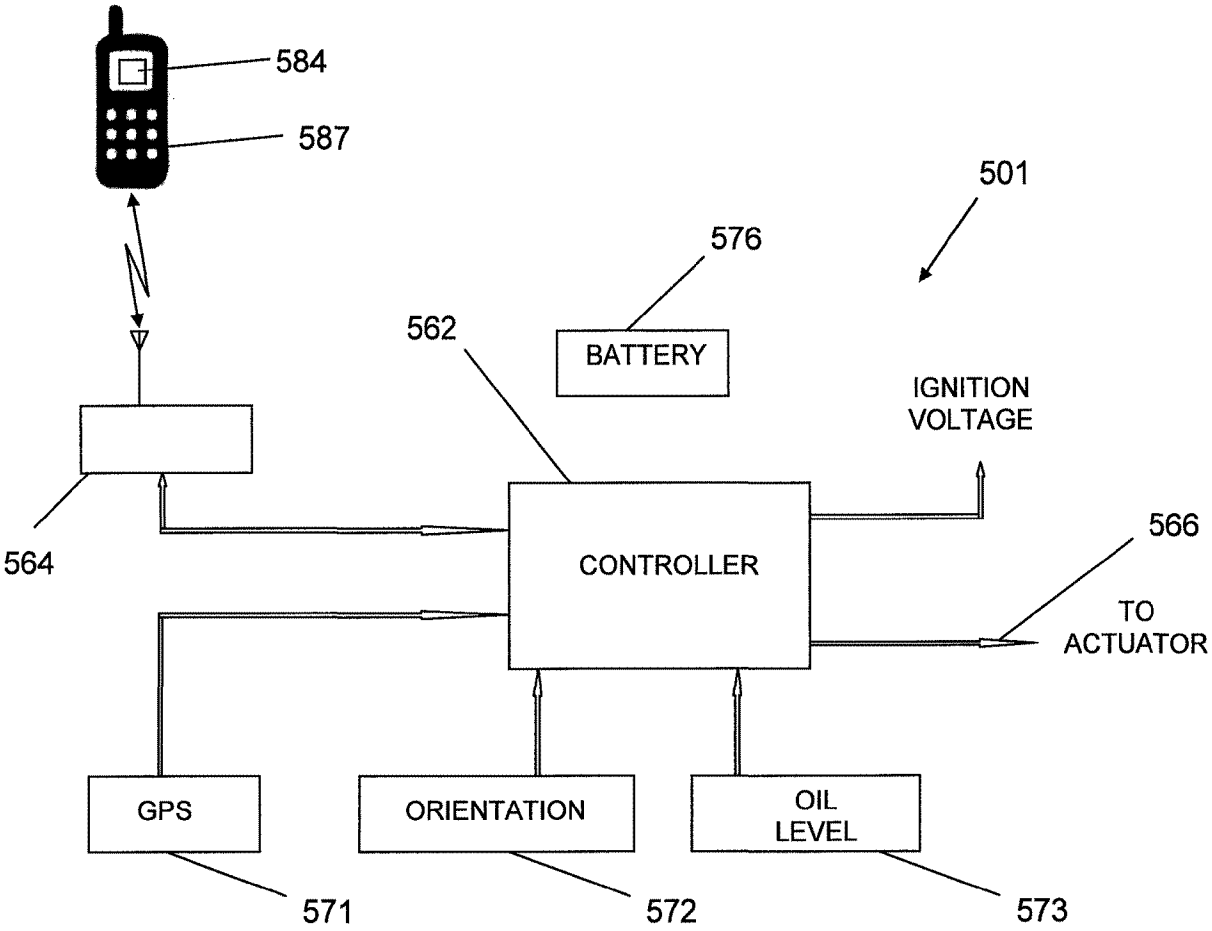
FIG. 10 is a block diagram of the control system used in conjunction with the candle device of FIG. 5.

FIG. 10 illustrates a block diagram of the control system of candle device 501, including controller 562, cellular transceiver 564, active component actuator 566, sensors 571-573, which are all powered by battery 576. An application 584 running on mobile device 587 is able to communicate with candle device 501 via transceiver 564 over the cellular network.

Application 584 has a dedicated user interface with virtual buttons that allows the user to initiate commands for activating the ignition device or the extinguishing device. Application 584 may also be configured to transmit such commands by various inputs such as by voice recognition. A pattern which is characteristic of blowing on the microphone of mobile device 587 may be determined by application 584 and converted to an extinguishing signal that is sent to the candle device.

By virtue of the reliable ignition and extinguishing means described above, the candle device of the present invention has many remote indication features.

Application 584 may receive real-time data from controller 562 and notify the user accordingly during the following extenuating situations:

1. When level sensor 573 is indicative that the level of the combustible material is less than a predetermined value, the user is notified that it is recommended not to activate the ignition device.
2. When orientation sensor 572 is indicative that the candle device is about to fall, the user is notified to activate the extinguishing device.
3. When a signal strength sensor is indicative that the signal strength is less than a predetermined value and that there will be an impending loss of communication, such as when the battery is weak or there is poor reception, leading to an inability to reliably extinguish a lit flame and rendering a safety hazard to the surroundings of the candle device, the user is notified to activate the extinguishing device.
4. When position sensor 571 is indicative that the user is distanced from the lit candle device, for example after being in its proximity, the user is notified to activate the extinguishing device.

If in response to receiving a notification, the user has not sent an extinguishing command, after a predetermined time, the controller will automatically extinguish the candle device.

It will be appreciated that the controller may automatically activate the extinguishing device during many of these situations in addition to, or in lieu of, the notification.

All the above description has been provided for the purpose of illustration and is not meant to limit the invention in any way.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. A remotely-controlled candle device, comprising:

a) an enclosure containing solid combustible material;

b) a wick disposed within said combustible material;

c) a conductor in a form of a vertical rod fixed to a base of said enclosure;

d) an electric unit in which is housed electric and communication equipment and a battery for powering said equipment;

e) a float through which said conductor passes, wherein dimensions of said float are allow said float to float on said combustion material when being in a fluid state of aggregation;

f) an ignition device secured to said float, said ignition device being in heat exchanger relation with an upper end of said wick and controlled by said electric and communication equipment, for controllably igniting said upper end and producing a flame;

g) one or more conductive elements connected to both said electric unit and to said ignition device; and h) an extinguishing device controlled by said electric and communication equipment for controllably extinguishing said flame, wherein said electric and communication equipment is operable to receive remote commands from a user device for activating said ignition device and said extinguishing device upon demand.

2. The candle device according to claim 1, wherein the extinguishing device comprises a cover that is configured to gradually cover the enclosure and to thereby prevent ingress of additional oxygen needed to sustain the flame.

3. The candle device according to claim 1, further comprising a planar and stationary support member, a motor mounted onto said support member, and a screw element kinematically connected to said motor for causing vertical displacement of the cover when in an opened position.

4. The candle device according to claim 2, wherein said cover is biased to a closed position, the candle device further comprising one or more vertically extending and elongated abutments attached to the support member with which corresponding ears of said cover are in sliding contact during vertical displacement of said cover to prevent pivotal displacement to a closed position of said cover.

5. The candle device according to claim 1, wherein the combustible material is wax.

6. The candle device according to claim 1, wherein said electric and communication equipment is provided with an on/off switch and is suitable to receive and/or send information to the user device, and is configured to turn the switch on or off according to the information provided by the user.

7. The candle device according to claim 1, wherein the remote commands are transmittable over a cellular network.

8. The candle device according to claim 1, configured to interface with a smartphone application running on the user device.

9. The candle device according to claim 1, wherein said electric and communication equipment comprises a position detector and a controller in data communication with said position detector which is configured to determine that the user device is separated more than a predefined distance from the candle device.

10. The candle device according to claim 6, configured to send an alert notification via the communication equipment to the user device, when found to be separated from the candle device by more than the predefined distance, as to a risk that the flame remains lit.

11. The candle device according to claim 6, configured to automatically activate the extinguishing device when the user device is found to be separated from the candle device by more than the predefined distance after having been separated therefrom less than another predefined distance.

12. The candle device according to claim 1, which is one of a plurality of candle devices that is simultaneously controllable by a single user device.

13. The candle device according to claim 1, wherein the electric unit further comprises an orientation sensor in data communication with the controller that is suitable to detect an angle of the candle device, the controller being operable to:

a) transmit an activation signal to the extinguishing device when the detected angle deviates from a predefined angle by greater than a predefined value; and b) disable the ignition of the candle device.

14. The candle device according to claim 8, wherein said smartphone application is operable to recognize a voice pattern which is characteristic of blowing on a microphone of the user device and to generate in response a remote command for extinguishing the candle device.

15. The candle device according to claim 1, wherein said float is made of Borosilicate glass.

* * * * *